US008636563B2

(12) United States Patent
Asen

(10) Patent No.: US 8,636,563 B2
(45) Date of Patent: Jan. 28, 2014

(54) BASE FOR A ROTATING GRINDING OR CUTTING TOOL, AND GRINDING OR CUTTING TOOL PRODUCED THEREFROM

(76) Inventor: Norbert Asen, Oberhofen (AT)

( * ) Notice: Subject to any disclaimer, the term of this patent is extended or adjusted under 35 U.S.C. 154(b) by 981 days.

(21) Appl. No.: 11/992,506

(22) PCT Filed: Sep. 26, 2006

(86) PCT No.: PCT/AT2006/000391

§ 371 (c)(1),
(2), (4) Date: Apr. 24, 2009

(87) PCT Pub. No.: WO2007/033396

PCT Pub. Date: Mar. 29, 2007

(65) Prior Publication Data

US 2010/0022169 A1 Jan. 28, 2010

(30) Foreign Application Priority Data

Sep. 26, 2005 (AT) ..... A 1581/2005

(51) Int. Cl.
*B24D 7/10* (2006.01)
*B24D 11/00* (2006.01)

(52) U.S. Cl.
USPC ..... 451/532; 451/450; 451/534; 451/535; 451/544; 451/546

(58) Field of Classification Search
USPC ..... 51/298; 451/449, 450, 488, 532, 533, 451/535, 531, 541, 546, 544
See application file for complete search history.

(56) References Cited

U.S. PATENT DOCUMENTS

| | | | | |
|---|---|---|---|---|
| 2,398,408 | A * | 4/1946 | Buell | 451/532 |
| 3,867,795 | A * | 2/1975 | Howard | 451/548 |
| 3,868,793 | A * | 3/1975 | Corcoran et al. | 451/548 |
| 3,896,593 | A * | 7/1975 | Rine | 451/548 |
| 4,021,209 | A | 5/1977 | Binkley | |
| 4,353,953 | A | 10/1982 | Morelock | |
| 4,448,591 | A | 5/1984 | Ohno | |
| 4,668,135 | A | 5/1987 | Hunt | |
| 4,757,645 | A | 7/1988 | Ozer et al. | |
| 4,949,511 | A | 8/1990 | Endo et al. | |
| 5,221,293 | A | 6/1993 | Ferlemann et al. | |
| 5,465,706 | A | 11/1995 | Sawluk | |
| 6,029,544 | A | 2/2000 | Katayama | |
| 6,358,133 | B1 | 3/2002 | Cesena et al. | |
| 6,783,450 | B1 * | 8/2004 | Meyer | 451/548 |
| 2002/0182997 | A1 | 12/2002 | Tiefenbach, Jr. | |

FOREIGN PATENT DOCUMENTS

| | | |
|---|---|---|
| CH | 653390 | 1/1986 |
| EP | 0501022 | 9/1992 |
| EP | 0756917 | 4/1995 |
| GB | 2028860 | 7/1978 |

* cited by examiner

*Primary Examiner* — Timothy V Eley
(74) *Attorney, Agent, or Firm* — Michael L. Dunn

(57) ABSTRACT

In a rotating grinding- or cutting tool, in particular a grinding wheel or grinding roller, on one body, a coating of abrasive material, e.g. cubic boron nitride (CBN) or diamond is applied. The body (2, 12, 22, 32, 42) has two side walls (2*a*, 12*a*, 22*a*, 32*a*, 42*a*; 2*a*, 12*a*, 22*a*, 32*a*, 42*a*) which are connected to each other on their peripheral region, with the side walls being constructed with fiber-reinforced composite, in particular carbon fiber-, glass fiber- or synthetic fiber-reinforced composite.

40 Claims, 9 Drawing Sheets

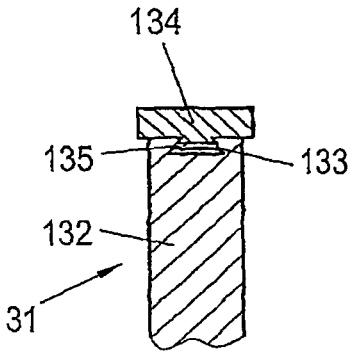
Fig. 14
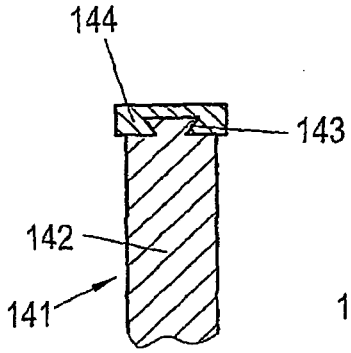
Fig. 15
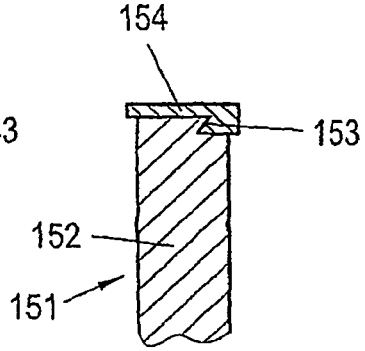
Fig. 16
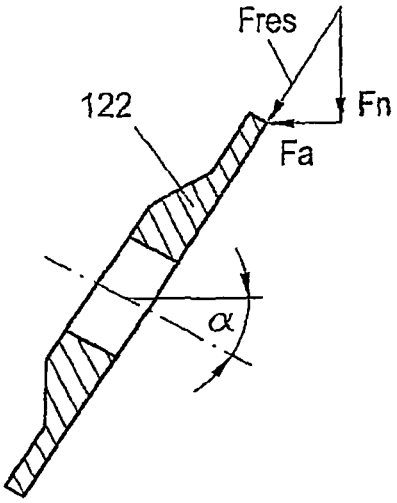
Fig. 17
Fig. 18
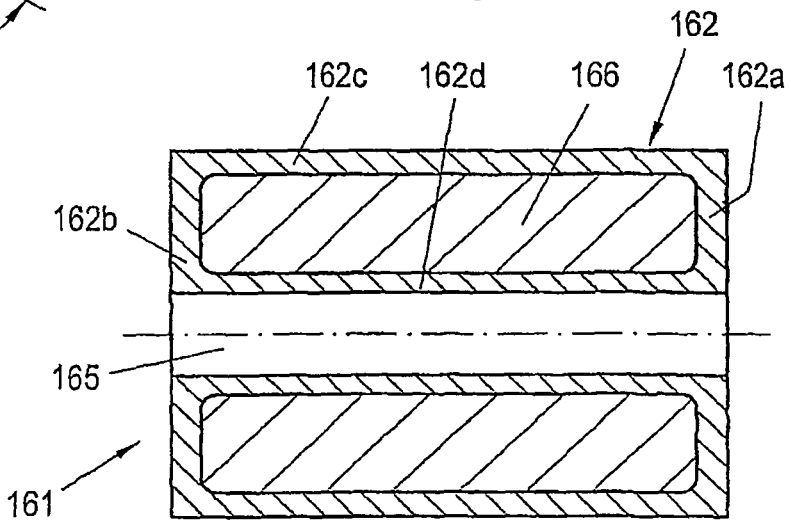

BASE FOR A ROTATING GRINDING OR CUTTING TOOL, AND GRINDING OR CUTTING TOOL PRODUCED THEREFROM

BACKGROUND OF THE INVENTION

The currently used high-speed grinding wheels include a body made of metal, particularly steel, aluminum or aluminum sintered alloys, onto which an abrasive material coated is applied, where the abrasive material coating can be applied to one peripheral surface of the body and/or to the lateral surfaces of the body.

One of the drawbacks of these traditional grinding wheels is their heavy weight that brings with it a considerable stress on the spindle of the grinder, on which the grinding wheel is fitted, as well as the bearings of the spindle. This weight-loading of the spindle and its bearings reduces the life of the spindle and spindle bearings and thus leads to increased expenditure for maintenance and repairs along with downtime for the grinder. The heavy weight of the traditional grinding wheels (typically in the range up to 100 kg) makes changing the grinding wheels manually difficult, if not impossible. In fact, a lifting device has to be used for nearly every change, which extends the changing process to several hours or requires a time-consuming change automatism, thus reducing the productivity of the grinder. Also in pendulum grinding, high volume of moved mass of the traditional grinding wheels become particularly noticeable and disruptive. The heavy weight also leads to increased energy consumption when powering the grinding wheel.

Another drawback of these traditional grinding wheels is their dynamic behaviour. As a result, a reversal of rotation direction is only possible at a very slow speed due to the high volume of moved mass. As the natural frequency of the metal body is mostly in the order of the speed of the grinding wheel, one has to expect the occurrence of natural oscillations. Due to the high volume of moved mass in the traditional grinding wheels, a tendency of an imbalance can also be detected, which increases proportionally to mass×distance. Ultimately with the traditional grinding wheels, only a limited grinding speed is achievable (which in practice is indicated in m/s peripheral speed). The reason for this is both the radial expansion of the bodies at higher speeds and the relatively high thermal expansion coefficient of steel and aluminum which, when heated during grinding, leads to greater error of measurement and in larger wheels, requires the abrasive material coating to be segmented.

Also well-known are fibre composite bodies, made of pre-impregnated Prepreg gauzes or bonded fabrics which, however, due to of their quasi-isotropic properties only have inadequate strength values, in particular when it comes to grinding applications with a lateral thrust load.

The basic task of the present invention is therefore to provide a body for a rotating grinding- or cutting tool and grinding- or cutting tool produced out of it, in which the drawbacks of available technology are avoided.

BRIEF SUMMARY OF THE INVENTION

The invention relates to a body for a rotating grinding- or cutting tool, in particular a grinding wheel, cup wheel or grinding roller where an abrasive material coating, such as cubic boron nitride (CBN) or diamond, can be applied to the body.

The invention further relates to a rotating grinding- or cutting tool, in particular a grinding wheel, cup wheel or grinding roller, where the tool has a body and at least one coating of an abrasive material, e.g. cubic boron nitride (CBN) or diamond, applied to one peripheral surface and/or at least one lateral surface of the body.

The invention further relates to a method for the production of a rotating grinding- or cutting tool.

The invention ultimately relates to a method for the operation of a rotating grinding- or cutting tool in accordance with the invention.

This task is solved by a body for a rotating grinding- or cutting tool in accordance with the invention. More particularly, the body is provided for a rotating grinding or cutting tool wherein the body (2, 12, 22, 32, 42) comprises at least two sidewalls (2*a*, 12*a*, 22*a*, 32*a*, 42*a*; 2*a*, 12*a*, 22*a*, 32*a*, 42*a*) having peripheral regions wherein at least two of the sidewalls are adjacent sidewalls connected at their peripheral region and wherein the sidewalls are constructed with fiber-reinforced composite having a coating of an abrasive material and the fiber in the composite is selected from the group consisting of carbon fiber-, glass fiber-, aramid fiber-, basalt fiber- and synthetic fiber. The abrasive material is preferably cubic boron nitride (CBN) or diamond and the tool is preferably a grinding wheel or grinding roller. The fibers may be micro-fibres or nano-fibres and the fiber reinforced composite is preferably impregnated with a synthetic resin.

Figure 13B:
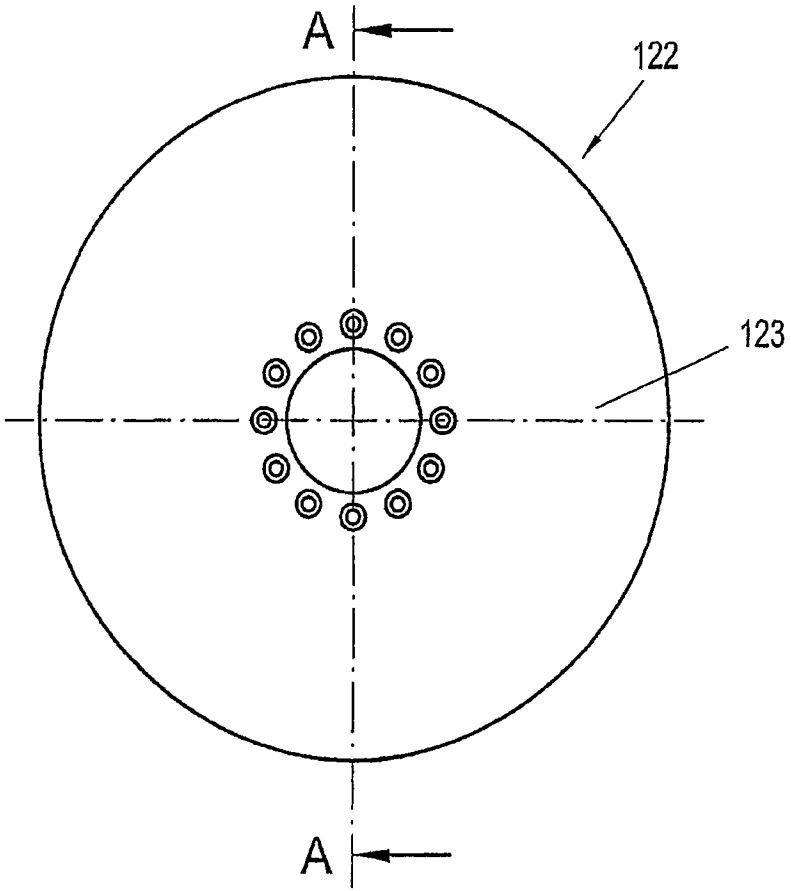
Figure 13A:
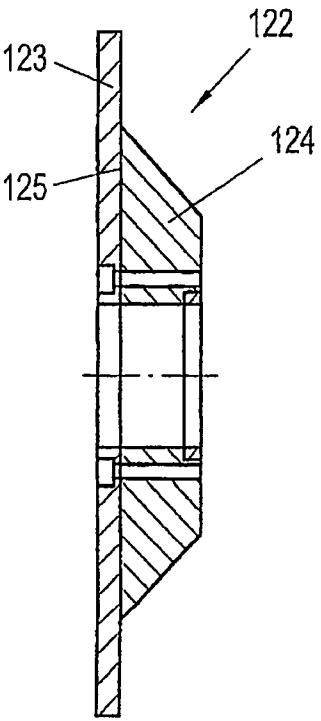

The FIGS. 13A and 13B show in a sectional view or in plan view a further version of a body in the present invention.

The FIGS. 14, 15, 16 show in cross section view versions of grinding- or cutting tools in the present invention that have a guided joint between the body of fibre-reinforced composite and a layer of abrasive material.

FIG. 17 explains a method for operating a rotating grinding- or cutting tool.

FIG. 18 shows in longitudinal section a further version of a drum-shaped body in the present invention.

DETAILED DESCRIPTION OF THE INVENTION

In accordance with the invention a body is provided for a rotating grinding or cutting tool wherein the body (2, 12, 22, 32, 42) comprises at least two sidewalls (2*a*, 12*a*, 22*a*, 32*a*, 42*a*; 2*a*, 12*a*, 22*a*, 32*a*, 42*a*) having peripheral regions wherein at least two of the sidewalls are adjacent sidewalls connected at their peripheral region and wherein the sidewalls are constructed with fiber-reinforced composite having a coating of an abrasive material and the fiber in the composite is selected from the group consisting of carbon fiber-, glass fiber-, aramid fiber-, basalt fiber- and synthetic fiber. The abrasive material is preferably cubic boron nitride (CBN) or diamond and the tool is preferably a grinding wheel or grinding roller. The fibers may be micro-fibres or nano-fibres and the fiber reinforced composite is preferably impregnated with a synthetic resin.

The rotation-symmetric body in the present invention for a rotating grinding- or cutting tool, in particular a grinding wheel, cup wheel or grinding roller, has two side walls which are connected to each other on their peripheral region, with the side walls having a fibre-reinforced composite, in particular a carbon fibre-, glass fibre-, aramid fibre-, basalt fibre-, or synthetic fibre-reinforced composite. Fibre-reinforced composites are also described in literature as fibre compound plastics. For best results, the fibre-composites are injected with a synthetic resin during the production process or thereafter which is then hardened, as a result of which the body can largely be created in free forms. To enhance the structural strength, micro-fibres or nano-fibres of a strength-reinforcing material, e.g. carbon fibres, glass fibres, aramid fibres, basalt fibres, or synthetic fibres, can be imbedded in the synthetic resin.

The body in the present invention is produced in a lightweight construction that allows its weight to be reduced to 1/10 of the weight of traditional metal bodies. However, with the use of fibre-reinforced composite, the body in the present invention offers extremely high strength and rigidity which, in a design with two side walls arranged at a distance from each other, is dramatically increased in terms of absorbing sheer forces. The drastically reduced weight of the body in the present invention leads to less spindle pressure for the grinder which extends the life of the grinding spindle and as a result reduces the maintenance and repair costs and downtimes in the production system. But even bodies produced as solid bodies have a considerably reduced weight compared to traditional bodies. Grinding tools produced using the body in the present invention have such a low weight that they can be fitted to the grinder without a lifting device which reduces the time required to change a tool to a fraction compared to that of traditional grinding wheels (up to 1 h instead of 5 h). With the greatly reduced weight of the body in the present invention, considerable reductions can be achieved in the electrical power required by the machine.

Another huge benefit of the body in the present invention or of rotating grinding and cutting tools produced using these bodies is the vibration-isolating behaviour of the composite or the good adjustability of the natural frequency of the tool to values that are considerably above the speed of the tool, preferably more than double or three times above it, with the result that natural oscillations remain low. The adjustability in terms of damping- and vibration behaviour is done mathematically or can be calculated iteratively. Because of the reduced weight, the occurrence of imbalance is also greatly reduced. Furthermore, higher machine dynamics are also achievable, i.e. the reversal of the rotation direction is substantially faster. The grinding wheel in the present invention is also particularly suitable for pendulum grinding or out-of-round grinding.

Grinding layers for high-speed grinding consist of the CBN/diamond-grain, bonding and pores where, for example, ceramic and synthetic resin-bound CBN/diamond layers are predominantly connected to the carrier through bonding. In the case of galvanically bound CBN grinding wheels, predominantly used in profiled grinding surfaces and gear grinding, a thin, metallic, optionally profiled ring is also set on the carbon- or CFK-carrier on the outer surface, so that the galvanising process is made physically possible.

In general terms, higher tool speeds are achievable with the body in the present invention without excessive material stress, as the body in the present invention made of fibre composites, compared to metal bodies shows very low material expansion at high speeds and offers substantially better dimension accuracy than the traditional body made of metal or CFK-prepregs. The higher speed or the higher peripheral speed of the tool also makes a higher work-piece rpm possible in conjunction with higher feed values. This leads to a greater machining capacity and increased productivity. Limits for the achievable speed are mainly set through the possible occurrence of burning.

Compared to traditional bodies, the thermal expansion coefficient of the body in the present invention made of composite is reduced; this leads to greater dimension accuracy across a large temperature range and, among other things, makes the segmenting of the abrasive grain-coating unnecessary, even with large wheels. The continuous coating of the bodies with abrasive material leads to better surface quality, improves the abrasive grain break-out behaviour, thus increasing the service life of the grinding wheel.

The areas of application for the invention are manifold, ranging from the development of the body in the present invention as a grinding wheel body through to the external and internal cylindrical grinding of components. Other areas of application for the invention include surface grinding, flute grinding, profile grinding and tool grinding. In particular, the invention can be used to good advantage in the areas of shaft grinding, such as in particular crank shaft grinding, drive shaft grinding, compressor wheel grinding, cam shaft grinding, roll grinding, rough grinding, gear grinding (where profiled wheels are used to absorb strong lateral loads, for which the present invention is ideally suited) and centreless grinding using a grinding wheel type in drum form, i.e. of a grinding roller, e.g. with a diameter up to over 1000 mm and a length beginning from approx. half a diameter up to multiples of the diameter. Such grinding rollers can be produced extremely well with the invention. The invention can also be used to produce combined components of flange and shaft root with bearing points and disc-shaped components. The invention also relates to grinding wheels and cup wheels for wafer grinding in the semi-conductor industry.

To create bodies with a peripheral surface of greater axial length, e.g. a body in drum form, it is preferable that the side walls on their peripheral region are not directly connected to one another, but rather via a peripheral wall that has the same composite as the side walls or another fibre-reinforced composite.

A specially light and highly stable extensive degree of freedom for the body is given during the shaping if between the side walls—at least in sections—a core material, in particular a honeycomb core, is arranged, preferably of aramid, or a foam core. Other suitable core materials include wood or mineral materials, such as granite. Cavity walls can also be suitable.

The body in the present invention allows its side walls and if necessary the peripheral wall to be designed as curved connecting elements or free-form surfaces. This allows rotating grinding tools to be produced based on this body in the present invention usable for challenging tasks like rough grinding and shoulder grinding.

To make it easier to fasten the bodies or a grinding wheel produced therefrom to the seat of a machine spindle it is useful, if the body has a hub that crosses the side walls centrally. The hub can, if required, be designed as a metal element.

To allow internal cooling or lubrication of the bodies one of the versions of the invention specifies that coolant- and lubricant connections and outlets should be formed in the body with preferably at least one coolant and lubricant connection created in a central area of one side wall, in particular in the area of the hub, leading into the space between the side walls and that at least one coolant and lubricant outlet be created through one side wall or through the outer peripheral wall and through perforated or porous grinding segments. The body is supplied with coolant and lubricant via the machine spindle, in which the relevant corresponding channels are created, or via lateral accesses.

To increase the resistance of the body in the present invention against compression stresses and to avoid material damage to the side walls of the body from crushing, in particular when it is clamped into a machine, one variant of the invention specifies that spacer sleeves leading through both side walls are provided, whereby the spacer sleeves should preferably be fixed to the side walls using press fit and adhesives. The spacer sleeves are, for example, fitted in one or more concentric circles in the force transmission area of the bodies. The spacer sleeves are preferably conically shaped so that there is a tight fit and they cannot break away from the body. It has also proven beneficial to precision balance the body by using steel pins of varying lengths and diameters with holes with the corresponding diameters being drilled in the body in a preparatory operation. Balancing can be achieved even by just providing the holes. The holes and steel inserts can be arranged on any pitch circles.

To achieve the best possible stability and rigidity in the body in the present invention, the invention suggests different beneficial directions for laying the fibres of the composite, which, depending on the design of the body, can be used individually or in combination. In a preferred design, the fibres of the composite are laid in the side walls or the peripheral wall based on the force path calculated for the use. In the process, fibres can also be wound around deviating points, with pins being used as deviating points. In particular, fibres of the composite in the side walls can be arranged to mainly run radial or curved from the centre of the side wall to the periphery to minimise the material expansion or component distortion. For the same purpose, the fibres can be specially arranged in the side walls and also in the peripheral wall in tangential peripheral direction in concentric or eccentric circles. A high degree of stability is also achieved, if in the side walls fibres of the composite are arranged circularly, running ellipsoidally and/or spirally from the centre to the periphery. Particularly with bodies with large axial length of the peripheral wall, it is beneficial to arrange fibres of the composite in the peripheral wall running in a helical curve in an axial direction. The rigidity of the body can be increased drastically if the fibres in the side walls and, if necessary, the peripheral wall are arranged in multi-layers, in particular cross-layers.

The rigidity of the body in the invention and its ability to absorb lateral forces can be further increased if the side walls are connected to each other with cross webs. The cross webs can be designed in any form, e.g. in radial straight direction, radial curved or in peripheral direction on different pitch circle diameters.

Excellent rigidity of the body in its peripheral region is achieved if a band is arranged with unidirectional reinforcement fibres around the peripheral region.

The weight of the body in the present invention can be further reduced and the necessary stability maintained if the thickness of the side walls tapers from a central area to the periphery or vice versa, at least in sections.

Further degrees of freedom in the design of the body in the present invention are obtained by sticking individual parts of the body together. For example, the diameter can thus be strengthened in a central area of the body.

The invention also provides for combining the actual body with flanges, shafts, spindles etc, either by the aforementioned sticking or through a one-piece design to reduce the total weight of this unit and thus be able to drive higher speeds at lower power consumption and achieve an optimised and integrated vibrating system.

In a particularly preferred version of the invention that allows the active damping of vibrations in the body, the fibre-reinforced composite of the side walls and, if necessary, the peripheral wall, is combined with energy converter material (so-called adaptive materials), such as piezoelectric, in particular piezoceramic foils and fibres, or magnetostrictive or electro-active materials. The energy converter materials are connected in part as sensors to an electrical control to detect mechanical vibrations as soon as they occur and from this derive a control signal which, in turn, is fed to other energy converter materials that are operated as actuators to counteract the mechanical vibrations. Piezo-fibres and foils without power feed can be used; however, these have a lower damping effect. The Piezo-fibres and foils may also be connected to energy stores or externally supplied with power via the spindle to achieve a greater damping effect.

Finally it is also planned in a version of the invention to insert a data carrier, preferably a non-contact, writeable and readable data carrier into one of the walls of the body to store production data etc.

The invention also involves a rotating grinding- or cutting tool, in particular a grinding wheel or grinding roller that has a body as in the present invention and at least one layer of abrasive material on one peripheral surface and/or at least one lateral surface of the body, this material can be cubic boron nitride (CBN) or diamond. In one version, the body is connected via a guided joint, in particular dovetailing, to the layer of abrasive material. Also, due to this fixed joint contrary to the state of art technology, it is possible to design the layer of abrasive material in one piece in ring form instead of segmented. As an alternative or supplement to the guided joint, the body can be connected via bonding to the layer of abrasive material.

According to the state of the art technology, CBN/diamond-abrasive layers are connected to the body with adhesive. The adhesive force can be considerably increased between the grinding layer and body in the present invention by integrated soaking or injecting with synthetic resin and hardening of the carbon fibre pre-forms etc. and the connection point of the grinding layer and the body under it. It takes one process step to soak the pre-forms of the body and adhesive joint. They then also harden jointly. To sum up, the production method in the present invention has the following steps:

- setting at least one grinding layer element in the mould tool,
- setting reinforcement fibres (pre-forms), in particular carbon fibres, glass fibres, aramid fibres, basalt fibres or synthetic fibres in a mould tool, the integrated soaking or injecting with synthetic resin and hardening of the reinforcement fibres and the connection points between the reinforcement fibres and the grinding layer elements.

Finally the invention also includes a method for operating a rotating grinding- or cutting tool as in the present invention, the characteristic of which is that the grinding- or cutting tool is deviated in the direction of the force resulting from the addition of vectors of clamping force and feed force. You can increase the stability of the grinding wheel body and the life of the grinding layer, by best compensating for the anisotropy of the resistance of the materials used.

The invention will now be described using non-restrictive possible versions with reference to the drawings.

Figure 1:
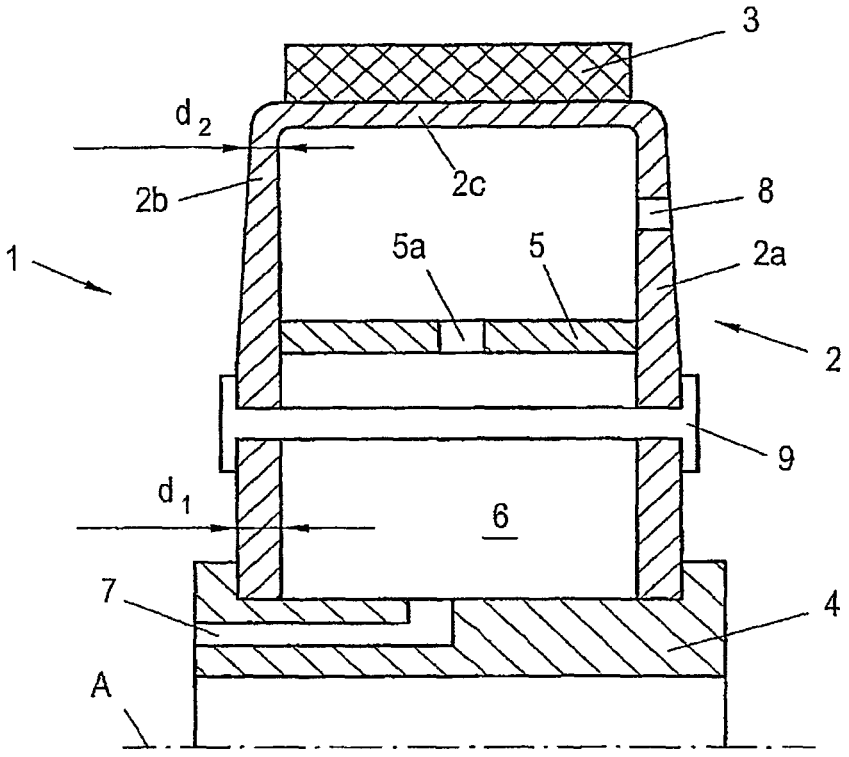
FIG. 1 shows a grinding wheel in the present invention in longitudinal section

FIG. 1 shows in longitudinal section an initial version of a grinding wheel 1 in the present invention. The grinding wheel 1 has a rotation-symmetrical body 2, on the periphery of which an abrasive material 3, e.g. cubic boron nitride (CBN), is applied. The body 2 has two side walls 2*a*, 2*b* spaced from each other that are connected to each other on their peripheral region via a peripheral wall 2*c*. The body 2 has a rotation-symmetrical design and has in its centre a hub 4 which can be turned around a rotating axis A. In the invention the side walls 2*a*, 2*b* and the peripheral wall are made of a fibre-reinforced composite, whereby carbon fibre-, glass fibre- or synthetic fibre-reinforced composites are preferred. Particularly suitable are carbon fibre-reinforced plastics (CFK), glass fibre-reinforced plastics (GFK) or synthetic fibre-reinforced plastics (SFK). Aramid or basalt fibres can also be used as reinforcement fibres. The reinforcement fibres may, in the course of the production method of the bodies 2, be embedded in a matrix of synthetic resin, in particular epoxy resin, and the synthetic resin may also contain micro-fibres or nano-fibres to increase strength, e.g. carbon fibres, glass fibres, aramid fibres, basalt fibres or synthetic fibres. The side walls 2*a*, 2*b*, the peripheral wall 2*c* and the hub 4 enclose a cavity 6. With the two-way spacing between the side walls 2*a*, 2*b*, the body 2 is ideally suited to absorb lateral forces. Its special feature is the low weight with simultaneous excellent strength and rigidity due to the use of fibre-reinforced composite. To further increase the rigidity of the body 2, the side walls 2*a*, 2*b* are connected to each other at around half the radius of the bodies via a circular, cylindrical bar 5. It should be mentioned that instead of a cylindrical bar 5, several individual bars may be provided, and they may be for example rod-shaped or in the form of a segment of a circle. To prevent the side walls 2*a*, 2*b* being damaged by shear forces or crushing, a large number of spacer sleeves 9, are fixed and arranged in a circle around the hub 4, via press fit going through the side walls 2*a*, 2*b* in the body 2. Alternatively, the body can also, at least in sections, be designed as solid bodies, where foam cores can be used to save weight, see FIG. 12.

Also in the hub 4 there is a coolant and lubricant connection 7, through which coolant and lubricant is fed from a machine spindle (not shown) into the cavity 6 of the body 2 and through a coolant and lubricant outlet 8 which is designed to go through the side-wall 2*a*, and which can be passed from the cavity 6 of the body 2. In order for the coolant and lubricant to reach into the peripheral region of the cavity 6 from the hub area, the cylindrical bar 5 has at least one clearance hole 5*a*. The outlet for the coolant and lubricant can also be through the peripheral wall and perforated or porous grinding segments. In principle, the body can also be made without a hub which is something that should be aimed at for cost reasons, in particular for less challenging applications.

For the purposes of saving weight, the wall thickness of the side walls 2*a*, 2*b* reduces from the hub area to the peripheral region, with from the hub 4 up to around the bar 5 initially a constant wall thickness d1 being provided, which then reduces to the peripheral region to a smaller wall thickness d2. The wall thicknesses d1, d2 are dimensioned based on the expected load on the body. The balancing quality of the body in the present invention can be set either via the production method chosen or via mechanical adjustment. The same applies to dimension-, form- and bearing tolerances, in particular to the roundness, the concentricity and the evenness as well as the parallelism on the force introductory point. It is also possible to design the body 2 without a separate hub, i.e., by at least in the centre area providing a solid body section, that can be directly connected to a machine spindle, where also spacer sleeves and spacer pins can be inserted into this solid body section. It has also proven beneficial to precision balance the body 2, by inserting steel pins of varying lengths and diameters into the solid body section, with holes with the corresponding diameters being drilled in a preparatory operation.

Figure 2:
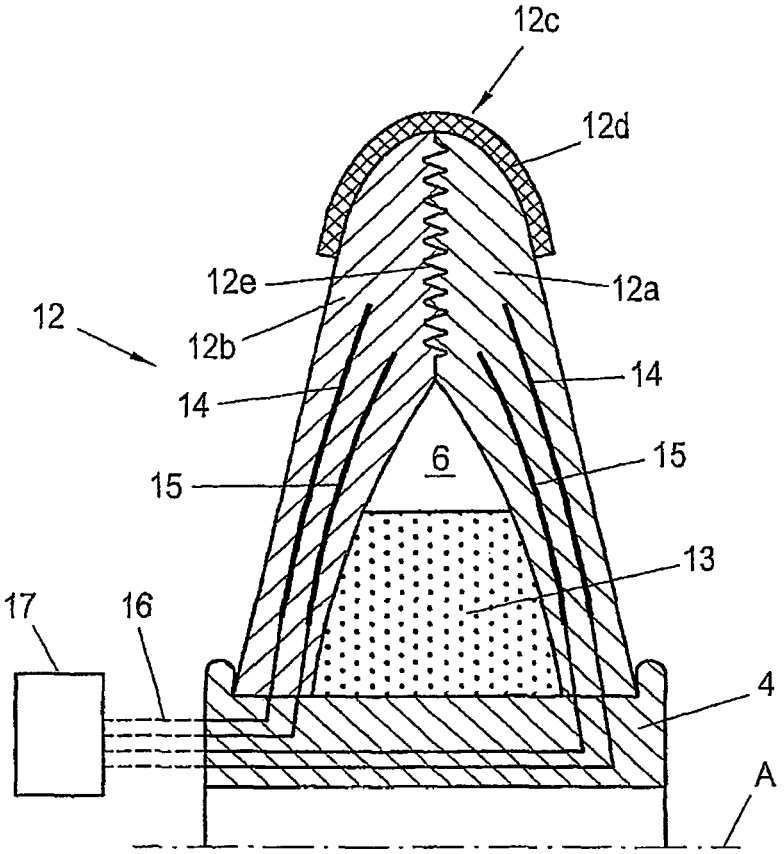
FIG. 2 shows a body in the present invention in longitudinal section

FIG. 2 shows another body in the present invention 12 in longitudinal section. This body 12 has two side walls 12*a*, 12*b*, that converge on each other towards the periphery 12*c*. The side walls 12*a*, 12*b* are directly connected to each other, i.e. without a peripheral wall in between. The reference sign 12*e* marks a connection joint. Also the side walls are surrounded on their peripheral region by a unidirectional band 12*d*—preferably of CFK—, that shows reinforcement fibres running in one direction. For practical reasons in production, first of all the unidirectional band 12*d* is placed in the mould and then the side walls 12*a*. 12*b* as pre-forms set in the mould, upon which a resin impregnation step and a hardening step are carried out. As the side walls 12*a*, 12*b* converge on each other towards the periphery, they define a cavity 6 between each other and partly filled with foam 13.

For active damping of vibrations in the body 12 and changing its rigidity, energy converter-materials 14, 15, also known in the sector as adaptive materials, are placed in the fibre-reinforced composite of the side walls 12*a*, 12*b*. These energy converter materials convert mechanical forces into electrical or magnetic forces or vice versa. These energy converter materials include e.g. piezoelectric, in particular piezoceramic foils and fibres, or magnetostrictive or electro-active materials. In the present version, the energy converter material designed as piezoceramic foils 14, 15 which, during the pre-form production for the side walls 12*a*, 12*b*, are placed between layers of the fibre-reinforced composite. In the process, some of the piezoceramic foils 14 are used as sensors which, as a result of vibrations, convert mechanical forces on them into electrical signals, and other piezoceramic foils 15 are used as actuators which counteract the vibrations detected with movements (displacement, shifting, expansion, contraction, deflection), these movements are controlled by an electronic controller 17 which, on the one hand receives the sensor signals of the piezoceramic foils 14 and calculates the relevant control signals from them, and on the other hand controls the piezoceramic foils 15 with these control signals. The controller 17 is connected to the piezoceramic foils via an electrical conductor 16. It is also possible, rather than the proposed active, electronically controlled damping, to make a simpler, semi-passive damping in which, instead of an electronic controller, there is a simple electrical wiring of the lines 16 that can be directly integrated into the body 12. For example: The electrical pulses supplied from the piezoceramic foils 14 can be fed to the piezoceramic foils 15 either directly or via intermediate storage in an electrical storage element. An even simpler, albeit worse damping in terms of effectiveness can be achieved where piezo fibres, and/or piezo elements without power supply, are used. The energy converter materials can also be applied on the outside or inside of the body's walls.

This body 12 can be beneficially produced by building up the side walls 12*a*, 12*b* as two component halves while forming the side walls from pre-forms of the fibre-reinforced composite, applying the foam 13 onto the side-wall 12*a*, placing the second side-wall 12*b* on the foam 13, so that both side walls are lying against each other at the connection point 12*d*, bringing up periphery fibres in the peripheral section 12*c*, placing the entire structure in a hardening mould not shown, the injecting (soaking) of the side walls 12*a*, 12*b* and their peripheral regions 12*c* connected, with a synthetic resin and hardening the synthetic resin and removing the body from the hardening mould. The hub 4 can then be pressed in.

Figure 3:
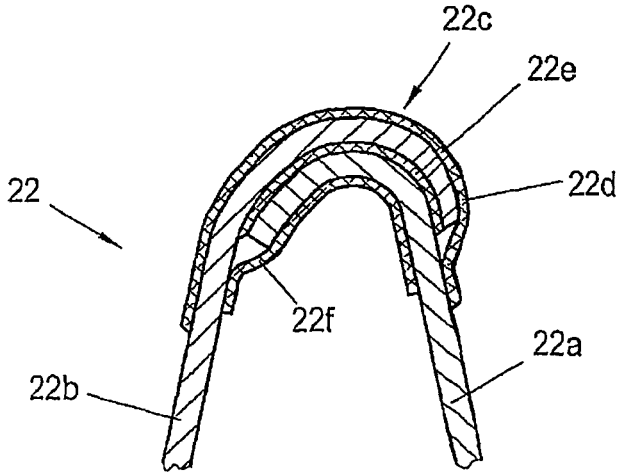
FIG. 3 shows a detail of another version of a body in the present invention.

FIG. 3 shows a detail of another version of a body in the present invention 22, in which the side walls 22*a*, 22*b* are arranged in such a way on the peripheral region 22*c* that they overlap each other across the whole peripheral region 22*c*, leading to excellent rigidity in the peripheral region 22*c*. It should be mentioned that the overlapping can also go so far that the side walls completely overlap each other, i.e. so that a two-walled design is produced. To further increase the strength of the body, three bands 22*d*, 22*e*, 22*f* with unidirectional reinforcement fibres are arranged around the peripheral section 22*c*, with the band 22*d* fixed externally around the side walls 22*a*, 22*b*, the band 22*e* between the side walls and the band 22*f* internally on the side walls 22*a*, 22*b*.

Figure 4:
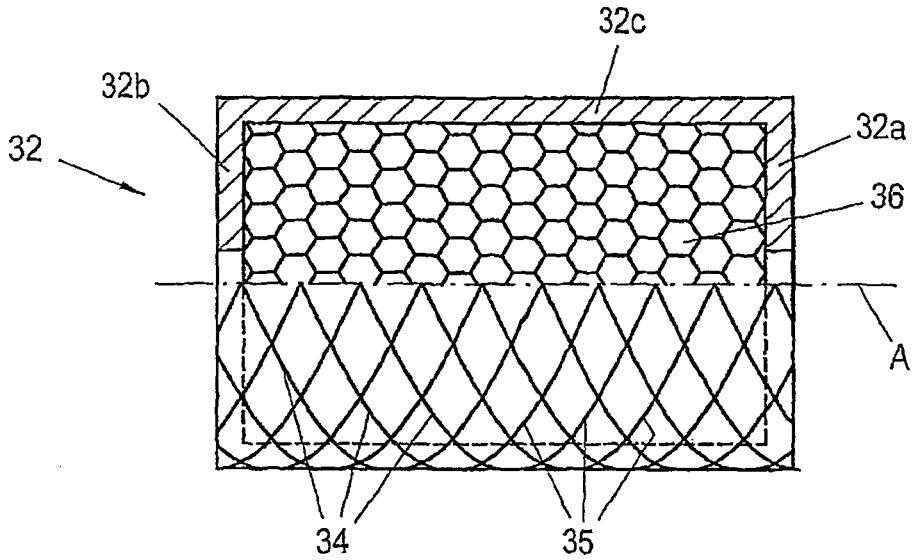
FIG. 4 shows in partial longitudinal section and in partial view a drum-shaped body as per the invention.

FIG. 4 shows in partial longitudinal section and in partial view a drum-shaped body 32 with side walls 32*a*, 32*b* which are connected to each other in large axial distance with a peripheral wall 32*c*, with the side walls 32*a*, 32*b* and the peripheral wall 32*c* built up on a foam core 36. The fibre-reinforced composite is in the process arranged in cross layers in the peripheral wall 32*c*, in such a way that the fibres 34, 35 extend in a helical curve in axial direction of the peripheral wall, with a wrap technique being use for the production. Here the fibres, before being wrapped, run through an impregnating bath, are then wound in the wet state in the desired configuration and then the body thus formed is hardened. The drum-shaped body 32 thus has a design with CFK-fibres on all sides and internal packing (core). The present version of the body 32 is ideally suited to the production of a grinding roller for the centreless grinding of products under the threading or plunge cut method, while for the plunge cut method, the peripheral wall 32*c* can also be constructed in a more complicated way (e.g. different cylindrical sections with varying diameters) to allow the grinding of products with forms other than the cylinder form.

A further version of a drum-shaped body 161 is shown in longitudinal sectional view in FIG. 18. The body 161 is designed as a hub-less body, i.e. it has a central cylindrical cavity 165 which is clipped onto a spindle in the operation. The body 161 has a structure 162 of fibre-reinforced plastic, whereby structure 162 has an internal wall 162*d* that defines the cavity 165, also side walls 162*a*, 162*b*, and an external peripheral wall 162*c*. These walls enclose a foam core 166. This body 161 is produced, by initially winding the inner wall 162 on a mandrel (not shown). Then the foam core 166 is put on and then the side walls 162*a*, 162*b* and the peripheral wall 162*c* are wound onto it. In production, before wrapping the fibres run through an impregnating bath, are then wound in the wet state in the desired configuration and then the body thus formed is hardened. The drum-shaped body 161 thus has a design with CFK-fibres on all sides and internal packing 166.

Figure 5:
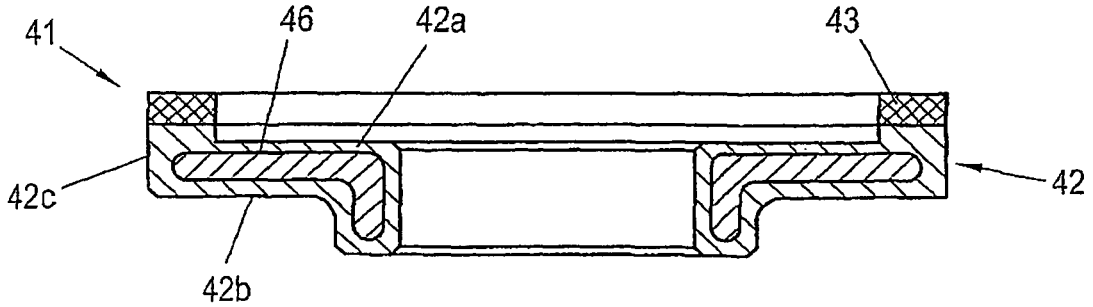
FIG. 5 shows a longitudinal section of a further version of a grinding wheel 41 in the present invention.

FIG. 5 shows a longitudinal section of a further version of a grinding wheel 41 in the present invention, which shows that the body 42 can also largely be built in free form. A foam core 46 is used, on which the side walls 42*a*, 42*b* are constructed, and which are joined to each other on the periphery 42*c*. The grinding wheel 41 is designed for lateral grinding, and therefore a ring-shaped coating 43 of abrasive material is applied to the side-wall 42*a*.

Using foam- and honeycomb cores, different versions of the body can be produced, e.g. shell moulds, wheels with recesses, cup wheels, in particular cup wheels specially designed for wafer grinding, chamfered shells, moulds with tapering, etc. It should also be mentioned that both side walls do not have to be spaced from each other across the whole body, but, at least in sections, cross over into each other, i.e. be able to form a full wall. A design with solid body is also possible.

As a rule, the bodies in the present invention are produced in several layers from one or more fibre-reinforced composites. To achieve high dimension accuracy, rigidity, stability and to prevent peripheral expansion, different ways of laying the fibres of the fibre-reinforced composite can be useful depending on the desired use. In the following, some basic ways of laying are discussed and these can be used individually or in combination.

Figure 6:
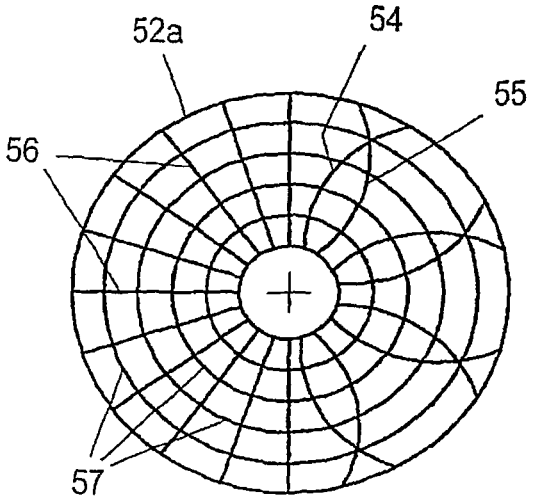
FIG. 6 shows in side elevation a side wall of a body in the present invention.

FIG. 6 shows in side elevation a side-wall 52*a*, in which in one half a curved run of fibres 54, 55 from the centre of the side-wall to its periphery is illustrated, with the fibres 54, 55 in cross layer, and in the other half of the side-wall 52*a* a radial run of fibres 56 is shown. Also the fibres 57 are provided in tangential run in the form of concentric or even eccentric circles.

Figure 7:
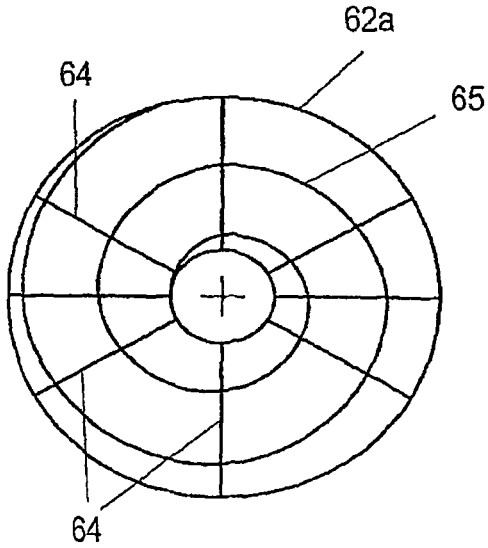
FIG. 7 shows in side elevation a side wall of another body in the present invention.

FIG. 7 shows in side elevation a side-wall 62*a*, in which the fibre 65 runs spirally from the hub to the periphery and lies in cross layer in with radial fibres 64. Instead of the spiral-shaped run, fibre can also be arranged multi-layered in circles (tangential arrangement), ellipses and concentric as well as eccentric circles.

Figure 8:
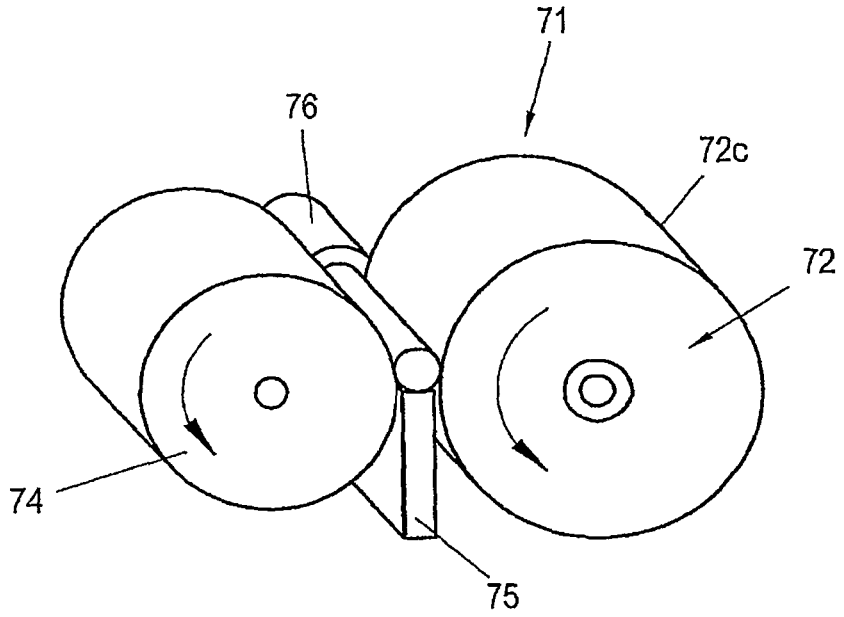
FIG. 8 shows an example of centreless grinding using a grinding roller with a body in the present invention.
Figure 9:
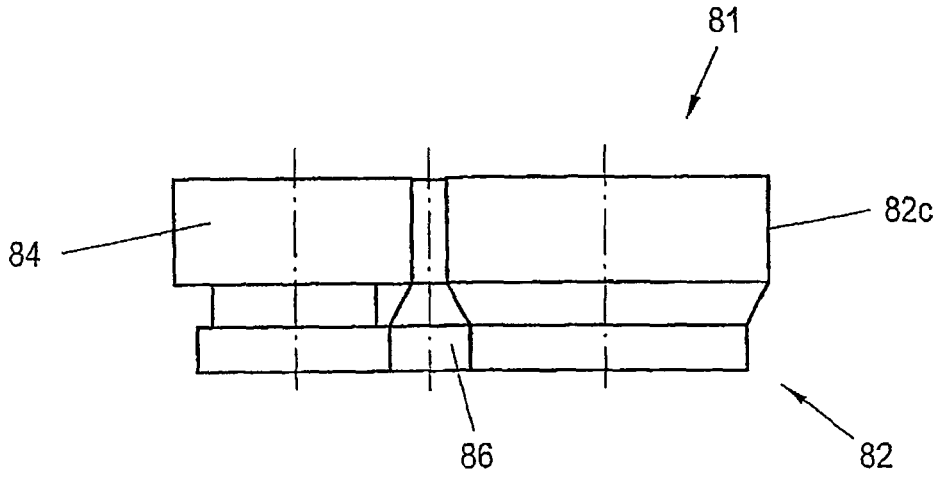
FIG. 9 shows a further example of centreless grinding using a grinding roller with a body in the present invention The FIGS. 10A and 10B show in a sectional view or in plan view a further version of a body in the present invention The FIGS. 11A and 11B show in a sectional view or in plan view a further version of a body in the present invention The FIGS. 12A and 12B show in a sectional view or in plan view a further version of a body in the present invention.

FIGS. 8 and 9 show examples of centreless grinding using a grinding roller 71, 81 with a body in the present invention 72, 82. The work piece 76, 86 to be ground lies on a support rail 75. A counter drum 74, 84 presses the work piece 76, 86 against the peripheral surface 72*c*, 82*c* of the grinding roller, with the peripheral surface 72*c* (FIG. 8) having a cylindrical form and the peripheral surface 82*c* (FIG. 9) is designed repeatedly offset.

To produce the body in the present invention, carbon fibre rovings (carbon rovings) or similar are used. An insert can be provided, e.g. of foam on which the walls of the fibre reinforced composite material are constructed. The body is conveniently connected to the abrasive material with an adhesive, in particular an epoxy resin adhesive.

Figure 10B:
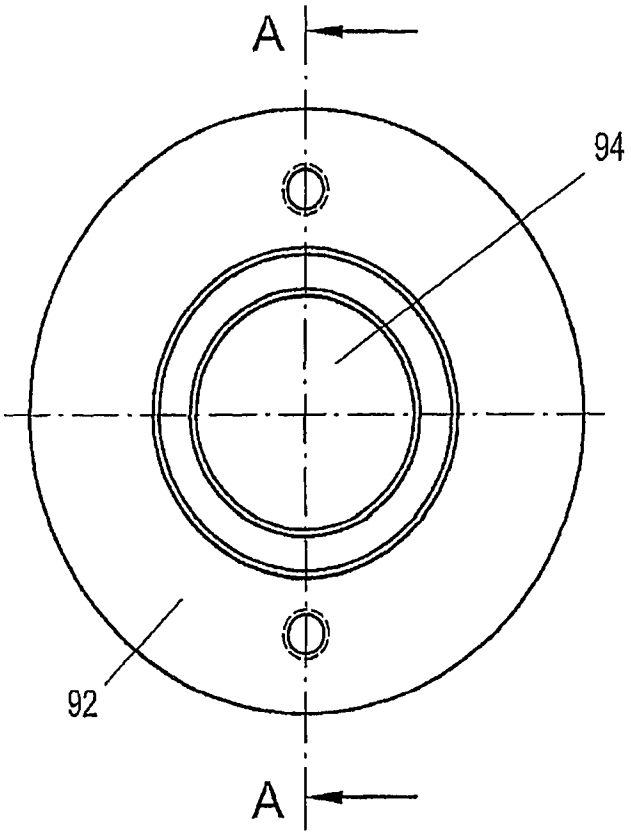
Figure 10A:
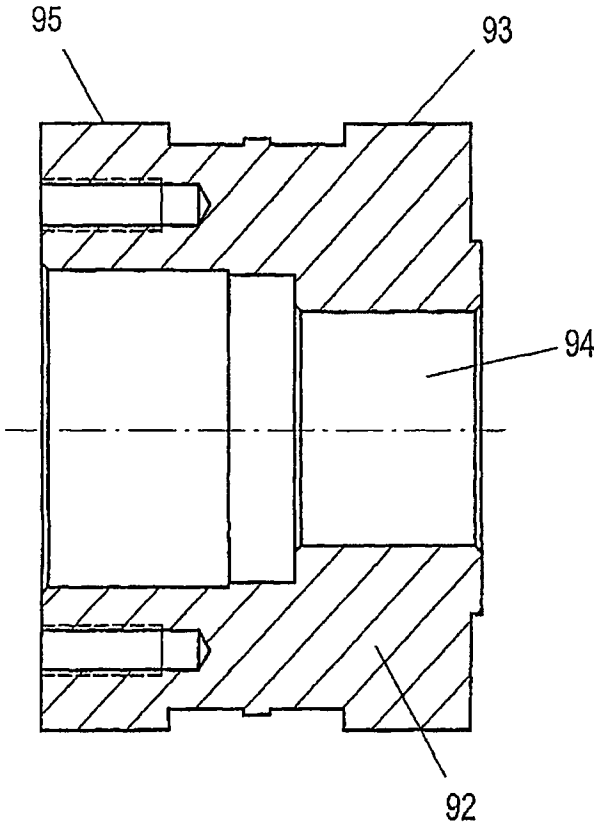

In FIGS. 10A and 10B, a further version of a body 92 in the present invention is shown; with FIG. 10B showing a plan view and FIG. 10A a sectional view as per the line A-A of FIG. 10B. This body 92 is suitable for the grinding of concave cam shafts and is designed as a solid body in a pure wrap technique. For production, carbon fibres (carbon rovings) or similar are wrapped around a rotating mandrel and pulled off a bobbin. The winding method is a wet method, which means that just before positioning on the winding mandrel, the carbon rovings are dragged through an impregnating bath and hardened in a furnace on completion of the winding process. The final geometry is created by mechanical CNC-processing. The main benefit of the body 92 is its low mass and thus the optimised unbalance-, damping- and thus vibration behaviour. The abrasive layer is set on trusses 93, 95 on the external diameter. The connection to the spindle is via a screwed joint through the internal hole 94. If a high precision fit is required, a steel insert can be set in the inside.

Figure 11B:
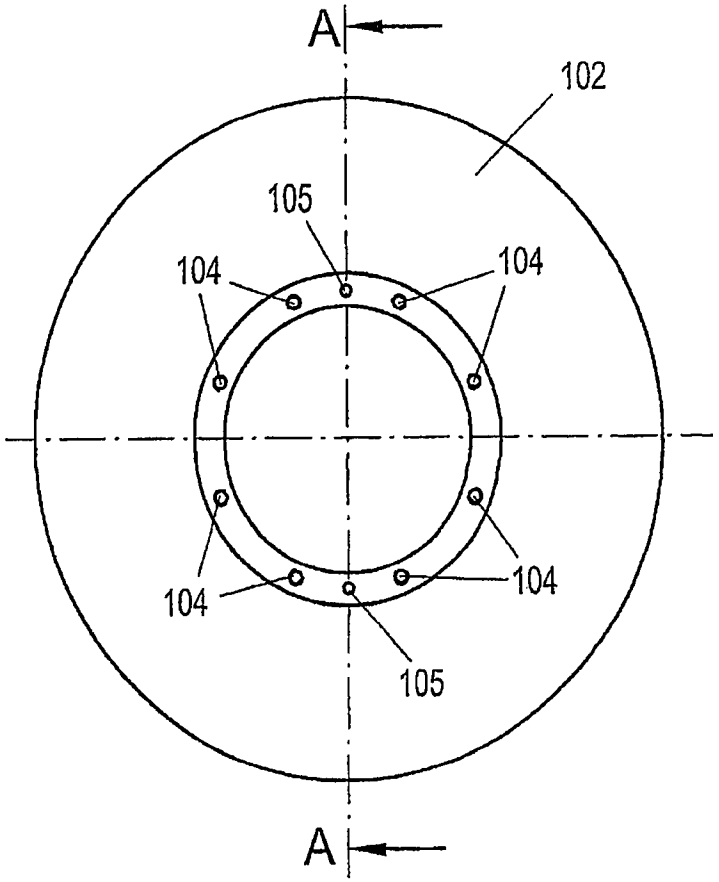
Figure 11A:
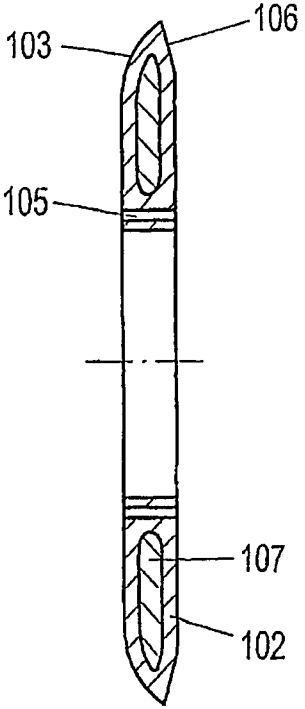

In the FIGS. 11A and 11B, a further version of a body 102 in the present invention is shown; with FIG. 11B showing a plan view and FIG. 11A a sectional view as per the line A-A of FIG. 11B. This body 102 is designed for the grinding of shafts with end faces or surface grinding. Shoulder grinding relates to shoulders of shafts, in which the surface is to be processed 90° to the longitudinal axis. The body 102 is once again constructed as a solid body of fibre-reinforced composite and offers CFK-compatible, completely new geometry with curved surfaces 103, 106 on both sides, onto which a layer of abrasive material is applied. Instead of the curved surfaces 103, 106, free-form surfaces can also be created. The body 102 is attached directly to a grinder via the threaded holes 104 or via the larger internal hole and has other small clearance holes 105, into which steel pins (not shown) of varying lengths for precision balancing can be inserted. Production is done with a full-fibre construction on a foam core 107.

Figure 12B:
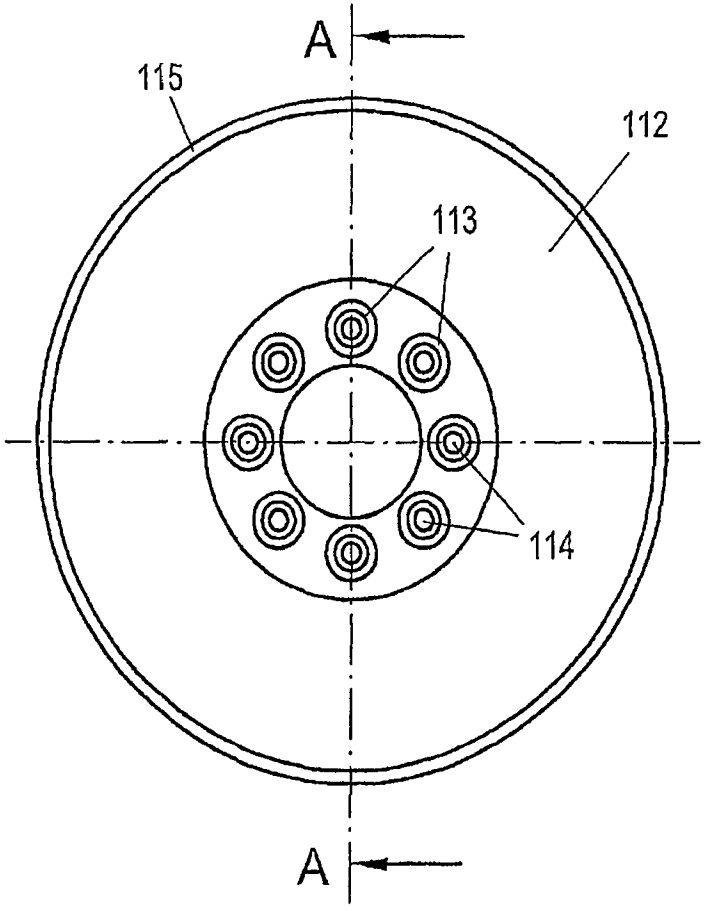
Figure 12A:
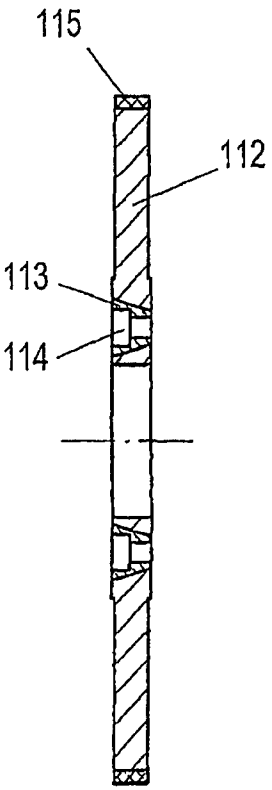

The FIGS. 12A and 12B show a further version of a body 112 in the present invention, with FIG. 12B showing a plan view and FIG. 12A a sectional view as per the line A-A of FIG. 12B. The body 112 is constructed with fibre-reinforced composite, into which are arranged in a circle, conical spacer sleeves 113, having clearance holes 114, so that the body 112 can be screwed directly onto a rotating spindle of a grinder. On the periphery of the body 112, a metal ring 115 is fitted as the basis for the galvanic applying/coating of a layer of abrasive material, in particular CBN/diamond grinding layer.

The FIGS. 13A and 13B show a further version of a body 122 in the present invention, with FIG. 13B showing a plan view and FIG. 13A a sectional view as per the line A-A of FIG. 13B. The body 122 is different from the previous versions in that it is made of two parts of fibre-reinforced composite, in fact of a cylindrical plate 123 and a conical reinforcement plate 124. Both plates 123, 124 are attached to each other on their interface 125. It should be mentioned that instead of the conical reinforcement plate 124, a spindle mantle of fibre-reinforced composite could be connected to the plate 123, giving rise to an assembly, which is a unit from the original cutting/grinding tool and has plate 123 as its body and is a spindle which can be connected to the drive of a grinder. The reinforcement plate 124 can also be designed in other materials such as steel or aluminum.

The invention also offers a rotating grinding- or cutting tool, in which a body of fibre-reinforced composite is connected by a guided joint to a layer of abrasive material. The guided joint should preferably be a dovetail joint. FIGS. 14, 15 and 16 each show in cross section versions of these types of grinding- or cutting tools. FIG. 14 shows a grinding wheel 131 with a body 132 of fibre-reinforced composite material and a layer 134 of abrasive material which is connected to the body 132 with a dovetail connection 133. In the dovetail area of the abrasive materials, there are through-holes 135 running crossways, through which in the production of the grinding wheel 131 fibres are fed to achieve an even better connection between the body 132 and abrasive material 134. FIG. 15 shows a grinding wheel 141 with a body 142 of fibre-reinforced composite material and a layer 144 of abrasive material, which is connected to the body 142 via a dovetail joint 143. This version is different from that in FIG. 14 because of its reversed dovetail which is regarded as even more durable, as the layer of abrasive material 144 sits on the outer surfaces of the dovetail element of the bodies 142 and it presses together when subjected to centrifugal forces. FIG. 16 shows a grinding wheel 151 with a body 152 of fibre-reinforced composite material and an outer ring of abrasive material 154 which is connected to the body 152 via a simple dovetail connection (undercut). This grinding wheel 151 is very easy to produce.

Another suggestion is to connect the bodies 132, 142, 152 with the layers of abrasive material 134, 144, 154 together not just via the guided dovetail connections, but also to bond them together, along with thermosetting plastics as adhesive also thermoplastics being used which are tougher than thermosetting plastics.

Under the current state of the art technology, segments of CBN and the bodies have been produced separately and then joined using an adhesive connection. The invention however suggests a different, new method of resolution in which, in one process step, a further improved bonding of the CBN segments, i.e. the abrasive material layer is created on the body out of fibre-reinforced composite material. This production method involves the following steps:

1) The segments of abrasive material are inserted/placed in the mould tool externally on the periphery prior to the pre-forms being inserted and even before the injecting of the bodies.
2) A guided dovetail connection can be created, by designing the pre-forms (these are the fibre halves not yet injected) of the body in such a way that a type of dovetail tongue or groove is created on the external diameter. The dovetail counter-block is then fitted on the inside of the layer.

2a) As an option, even before the injecting, the segments are brushed with a suitable epoxy resin adhesive. This warm hardening epoxy resin adhesive must have the best possible bonding with the epoxy resin which is used on injecting and hardening of the carrier, or the same epoxy resin can also be used.

3) Joint injecting, tempering and hardening of the preforms and the adhesive surface with the inserted segments of abrasive material.

The production manner proposed in the grinding/cutting tool in the present invention also allows ring layers of abrasive material to be designed instead of the traditional segments, to generate alongside the bonding or adhesion, a form fit with the body.

On the basis of FIG. 17, a method for operating a rotating grinding- or cutting tools is explained which, in this sample version, has the traditional body 122 in FIGS. 13A and 13B. The aim of the method in the present invention is to best absorb the forces occurring in the operation of the tool, i.e. with the least component deformation. The bodies in the present invention of fibre-reinforced composite can absorb high normal forces, i.e. the clamping forces Fn without component deformation, are however—depending on the design—susceptible to component deformation when axial forces occur, i.e. in the case of feed forces Fa as these do not achieve the rigidity in any direction like isotropic materials such as steel. The operating method in the present invention now suggests that the grinding- or cutting tool is deviated in the direction of the force Fres resulting from the addition of vectors of clamping force Fn and feed force Fa. FIG. 17 shows the addition of vectors and the resulting angle of deviation $\alpha$. In this deviation, the resulting force Fres acts on the body 122 just like a normal load.

In summary the body (2, 12, 22, 32, 42) comprises at least two sidewalls (2*a*, 12*a*, 22*a*, 32*a*, 42*a*; 2*a*, 12*a*, 22*a*, 32*a*, 42*a*) having peripheral regions wherein at least two of the sidewalls are adjacent sidewalls connected at their peripheral region and wherein the sidewalls are constructed with fiber-reinforced composite having a coating of an abrasive material and the fiber in the composite is selected from the group consisting of carbon fiber-, glass fiber-, aramid fiber-, basalt fiber- and synthetic fiber. The abrasive material is preferably cubic boron nitride (CBN) or diamond and the tool is preferably a grinding wheel or grinding roller. The fibers may be micro-fibres or nano-fibres and the fiber reinforced composite is preferably impregnated with a synthetic resin.

The side walls are connected to each other on their peripheral regions through a peripheral wall (2*c*, 32*c*) of fibre-reinforced composite and the sidewalls are adjacent or opposing and opposing the side walls (2*a*, 12*a*, 22*a*, 32*a*, 42*a*; 2*a*, 12*a*, 22*a*, 32*a*, 42*a*) are spaced from each other. A core of core material is present in at least a portion of space between opposing sidewalls. The core is usually at least partly made from foam, wood, plastic honeycomb or a mineral material. It is to be understood that the body could also be a solid body.

Desirably, at least some of the sidewalls and peripheral regions may have curved or free-form surfaces.

Usually a hub (4) centrally crosses a plurality of the sidewalls and coolant and lubricant connections (7) and outlets (8) are formed within the body. Desirably, at least one coolant and lubricant connection (7) formed in a central area of one side wall in the area of hub (4), and leading into a space (6) between the sidewalls and at least one coolant and lubricant outlet (8) is created through one side wall (2*a*) or through a peripheral region and through perforated or porous grinding segments Conically shaped spacer sleeves (9) can be provided that pass through at least two of the sidewalls (2*a*, 2*b*) and/or spacer pins are provided, with the spacer sleeves and/or spacer pins being press fitted and/or bonded in the sidewalls.

The fibres of the composites of at least some of the sidewalls are desirably oriented to provide strength along a force path calculated for the use and fibers may be wrapped around deviating points. Also, fibers of the composite may be arranged in the side walls running radially (56, 64), curved (54, 55), circular, tangential and/or elliptical from a center of the side-wall (52*a*, 62*a*) to its periphery and fibers of the composite, at least in the area of the sidewalls or in the peripheral wall, may be arranged in a peripheral direction and may be arranged to run spirally from their centers to their periphery or in the peripheral wall (32*c*) fibres (34, 35) of the composite may be arranged to run in a helical curve in an axial direction.

The fibres in at least some of the side walls and peripheral walls are desirably arranged in several layers and in at least some of the side walls and peripheral walls may be in cross layers.

Some or all of the side walls may be interconnected by cross webs (5) and thickness (d1, d2) of at least a portion of some of the sidewalls tapers from a central area of the sidewalls towards its periphery or vice versa. The side walls (22*a*, 22*b*) are preferably arranged on the peripheral region (22*c*) in such a way that they overlap each other across the entire peripheral region (22*c*).

At least one band (12*d*; 22*d*, 22*e*, 22*f*), of unidirectional reinforcement fibres, may be arranged around a peripheral section.

The body may have an integrated shaft or an integrated spindle mantle with a connection option to a drive.

The peripheral wall may be combined with energy converter materials (14, 15), such as piezo electrics, in particular piezoceramic foils and fibres, or magnetostrictive or electroactive materials, where the energy converter materials can on the one hand be optionally connected as sensor to an electrical control and on the other hand controlled by the electrical control as actuators and can have an inbuilt data carrier, preferably a non-contact, writable and readable data carrier.

The invention includes the body itself and a rotating grinding- or cutting tool (1, 41) having a body in accordance with the invention.

The natural frequency of the tool is adaptable or can be set to values that are above the nominal rotational frequency of the tool, with the natural frequency preferably being at least double the nominal rotational frequency and, even more preferably, at least three times the nominal rotational frequency.

An electrically conductive metal ring may be arranged on the outside of the body for use in galvanically applying the coating of the layer of abrasive material. The body may also be connected to the layer of abrasive material via a guided joint in the form of dovetailing and a part of the guided joint, through-holes may be provided to accept fibres.

The body may be connected to the layer of abrasive material via bonding in the form of a thermosetting or thermoplastic adhesive. The layer of abrasive material may also be finished in one piece and later secured to the body.

The invention also includes a method for producing s machine in accordance with the invention, e.g. by placing at least one grinding layer element in a mold, placing reinforcement fibers in the mold, introducing resin into the mold including soaking or injecting the fibers with the synthetic resin and hardening of the resin. This can also be done by placing at least one grinding layer element in a mould tool, placing reinforcement fibres or pre-forms in the mould tool, the integrated soaking or injecting with synthetic resin of the reinforcement fibres or pre-forms and the joints between the reinforcement fibres or pre-forms and the grinding layer elements in a process step with the same synthetic resin, as well as the joint hardening of the injected pre-forms and the connection point between abrasive layer and body.

A method for operating a rotating grinding or cutting tool as described herein is provided by deviating the grinding- or cutting tool the direction of the force resulting from the addition of vectors of clamping force and feed force.

What is claimed is:

1. A body for a rotating grinding or cutting tool wherein the body comprises at least two sidewalls each of which having its own thickness and having its own periphery wherein said at least two sidewalls are connected at their peripheries, wherein said at least two sidewalls are spaced from each other to define a cavity and wherein said at least two sidewalls are constructed with fiber-reinforced composite having a coating of an abrasive material and the fiber in the composite is selected from the group consisting of carbon fiber, glass fiber, aramid fiber, basalt fiber- and synthetic fiber.

2. A body as defined in claim 1 wherein the abrasive material is cubic boron nitride (CBN) or diamond.

3. A body as defined in claim 1 where the tool is a grinding wheel or grinding roller.

4. A body as defined in claim 1 wherein the fiber-reinforced composite is impregnated with a synthetic resin.

5. A body as defined in claim 1 wherein the fibers are micro-fibers or nano-fibers.

6. A body as defined in claim 1 wherein the sidewalls are connected to each other at their peripheries through a peripheral wall of fiber-reinforced composite.

7. A body as defined in claim 6 wherein fibers of the composite, at least in the area of the sidewalls or in the peripheral wall, are arranged in a peripheral direction.

8. A body as defined in claim 6 wherein in the peripheral wall (32*c*) fibers (34, 35) of the composite are arranged to run in a helical curve in an axial direction.

9. A body as defined in claim 6 wherein the fibers in at least some of the sidewall and peripheral wall are arranged in several layers.

10. A body as defined in claim 9 wherein fibers of the composite are arranged in at least some of the sidewalls and peripheral walls in cross layers.

11. A body as defined in claim 6 where the peripheral wall is combined with energy converter materials.

12. The body of claim 11 wherein the energy converter material is selected from the group consisting of piezoceramic foils and fibers, magnetostrictive materials and electroactive materials, connectable as a sensor to an electrical control and controlled by the electrical control as actuators.

13. A rotating grinding- or cutting tool comprising a body in accordance with claim 6.

14. A body as defined in claim 1 wherein a core of core material is present in at least a portion of the cavity between opposing sidewalls.

15. A body as defined in claim 14 wherein the core comprises foam, wood, plastic honeycomb or a mineral material.

16. The body of claim 15 wherein the core comprises a foam.

17. A body as defined in claim 1 wherein at least some of the sidewalls and peripheries comprise curved and/or free-form surfaces.

18. A body as defined in claim 1 wherein a hub centrally crosses a plurality of the sidewalls.

19. A body as defined in claim 18 wherein at least one coolant and lubricant connection is formed in a central area of one sidewall in the area of the hub, and leads into the cavity between the sidewalls and at least one coolant and lubricant outlet is created through one sidewall or through a peripheral wall and through perforated or porous grinding segments.

20. A body as defined in claim 1 wherein coolant and lubricant connections and outlets are formed within the body.

21. A body as defined in claim 1 wherein conically shaped spacer sleeves pass through at least two of the sidewalls and/or spacer pins are provided, with the spacer sleeves and/or spacer pins being press fitted and/or bonded in the sidewalls.

22. A body as defined in claim 1 wherein the fibers of the composites of at least some of the sidewalls are oriented to provide strength along a force path adequate for the use of the body.

23. A body as defined in claim 22 wherein fibers are wrapped around deviating points.

24. A body as defined in claim 22 wherein fibers of the composite are arranged in the sidewalls running radially, curved, circular, tangential and/or elliptical from a center of each sidewall to its periphery.

25. A body as defined in claim 1 wherein in the sidewalls, (65) of the composite are arranged to run spirally from the centers of the sidewalls to their periphery.

26. A body as defined in claim 1 wherein at least some of the sidewalls are interconnected by cross webs.

27. A body as defined in claim 1 wherein the thickness of at least a portion of some of the sidewalls tapers from a central area of the sidewalls towards its periphery or from its periphery towards a central area of the sidewalls.

28. A body as defined in claim 1 having at least one band of unidirectional reinforcement fibers, arranged within the peripheral sidewall in a peripheral direction.

29. A body as defined in claim 1 wherein the body has an integrated shaft or an integrated spindle mantle with a connection option to a drive.

30. A body as defined in claim 1 having an inbuilt data carrier.

31. A body as defined in claim 30 wherein the date carrier is a non-contact, writable and readable data carrier.

32. A rotating grinding- or cutting tool comprising a body in accordance with claim 1.

33. A rotating grinding or cutting tool as defined in claim 32 having a natural frequency wherein its natural frequency can be set to values that are above a nominal rotational frequency of the tool.

34. A rotating grinding or cutting tool as defined in claim 33 wherein the natural frequency is at least three times the nominal rotational frequency.

35. A rotating grinding or cutting tool as defined in claim 33 wherein the natural frequency is at least double the nominal rotational frequency.

36. A rotating grinding or cutting tool as defined in claim 32 wherein an electrically conductive metal ring is arranged on the outside of the body used for galvanically applying the coating of abrasive material.

37. The rotating grinding or cutting tool as defined in claim 32 where the body is connected to the coating of abrasive material via a guided joint in the form of dovetailing.

38. A rotating grinding- or cutting tool as defined in claim 37 wherein in a part of the guided joint, through-holes are provided to accept fibers.

39. The rotating grinding- or cutting tool as defined in claim 32 where the body is connected to the coating of abrasive material via bonding in the form of a thermosetting or thermoplastic adhesive.

40. A rotating grinding- or cutting tool as defined in claim 32 wherein the coating of abrasive material is finished in one piece.

* * * * *